US009035789B2

(12) United States Patent
Loi et al.

(10) Patent No.: US 9,035,789 B2
(45) Date of Patent: May 19, 2015

(54) METHOD AND APPARATUS FOR AUTOMATIC DOWN-HOLE ASSET MONITORING

(75) Inventors: Duke Loi, Frisco, TX (US); Tim Mueller, Plano, TX (US); Kathleen Hanafan, Sugar Land, TX (US)

(73) Assignee: HM ENERGY, LLC, Houston, TX (US)

( * ) Notice: Subject to any disclaimer, the term of this patent is extended or adjusted under 35 U.S.C. 154(b) by 829 days.

(21) Appl. No.: 13/196,642

(22) Filed: Aug. 2, 2011

(65) Prior Publication Data

US 2012/0075113 A1 Mar. 29, 2012

Related U.S. Application Data

(60) Provisional application No. 61/369,885, filed on Aug. 2, 2010.

(51) Int. Cl.

| | |
|---|---|
| ***H04Q 5/22*** | (2006.01) |
| ***E21B 47/12*** | (2012.01) |
| ***E21B 44/00*** | (2006.01) |

(52) U.S. Cl.

CPC ..... *E21B 47/122* (2013.01); *E21B 44/00* (2013.01)

(58) Field of Classification Search

USPC ..... 340/10.1, 850–872.1; 166/255.1

See application file for complete search history.

(56) References Cited

U.S. PATENT DOCUMENTS

| | | | | |
|---|---|---|---|---|
| 4,204,636 | A * | 5/1980 | Hayman | 235/383 |
| 6,759,968 | B2 * | 7/2004 | Zierolf | 340/854.8 |
| 2005/0104685 | A1 | 5/2005 | Kuroki et al. | |
| 2005/0237130 | A1 * | 10/2005 | Iwamoto et al. | 333/133 |
| 2007/0023185 | A1 * | 2/2007 | Hall et al. | 166/255.1 |
| 2009/0051246 | A1 | 2/2009 | Mueller | |
| 2009/0188675 | A1 * | 7/2009 | Bloom et al. | 166/381 |
| 2009/0265964 | A1 * | 10/2009 | Jiang et al. | 38/2 |
| 2010/0127828 | A1 * | 5/2010 | Connolly et al. | 340/10.1 |
| 2013/0345693 | A1 * | 12/2013 | Brannan | 606/33 |

OTHER PUBLICATIONS

Patent Cooperation Treaty; Korean Intellectual Property Office; International Search Report of PCT/US2011/044976; Han Jae Guyn; Feb. 23, 2012; 3 pages.

* cited by examiner

*Primary Examiner* — Van Trieu
*Assistant Examiner* — Royit Yu
(74) *Attorney, Agent, or Firm* — Howison & Arnott, LLP

(57) ABSTRACT

A method and apparatus for automatic down-hole asset monitoring is provided that monitors tagged down-hole assets wherein the assets travel into and out of an oil or gas well. A rig reader system, a controller and a computer incorporating a graphic user interface are connected to monitor tagged assets moving into and out of a drill head. The rig reader portion may be a ring shaped device having therein an integrated antenna array and radio frequency identification interrogators that interrogate an SAW or RFID tag as it moves through the ring shaped device. The integrated antenna array may include evenly distributed antennas about an interior surface of the ring shaped device that are covered by a radome that seals the antenna array and interrogators against contamination from caustic chemicals and other substances found on or around an oil rig platform. The ring shaped rig reader may be mounted directly below or above a rotary table or a rig's floor or be between a well head of an oil and gas well and the rig floor. The rig reader of an exemplary rig reader system is adapted to withstand a wide temperature range, caustic chemicals, shock and vibration and other elements commonly present on and about an oil or gas rig.

16 Claims, 8 Drawing Sheets

RIG READER SYSTEM BLOCK DIAGRAM

METHOD AND APPARATUS FOR AUTOMATIC DOWN-HOLE ASSET MONITORING

CROSS-REFERENCE TO RELATED APPLICATIONS

This application claims benefit from U.S. Provisional Application No. 61/369,885, filed Aug. 2, 2010, entitled METHOD AND APPARATUS FOR AUTOMATIC DOWN-HOLE ASSET MONITORING, the specification of which is incorporated herein by reference.

This application is related to U.S. patent application Ser. No. 13/188,748, filed Jul. 22, 2011, entitled METHOD AND APPARATUS FOR PACKAGING SURFACE ACOUSTIC WAVE-TRANSPONDER FOR DOWN-HOLE APPLICATIONS, which claims benefit from U.S. Provisional Application No. 61/366,792, filed Jul. 22, 2010, entitled METHOD AND APPARATUS FOR PACKAGING SURFACE ACOUSTIC WAVE TRANSPONDER FOR HARSH ENVIRONMENT, U.S. Provisional Application No. 61/366,784, filed Jul. 22, 2010, entitled METHOD AND APPARATUS FOR PACKAGING SURFACE ACOUSTIC WAVE TRANSPONDER FOR DOWN-HOLE APPLICATIONS, and U.S. Provisional Application No. 61/436,918, filed Jan. 27, 2011, entitled METHOD AND APPARATUS FOR PACKAGING SURFACE ACOUSTIC WAVE TRANSPONDER FOR DOWN-HOLE TOOLS, which are related to U.S. patent application Ser. No. 13/085,996, filed Apr. 8, 2011, entitled SURFACE ACOUSTIC WAVE TRANSPONDER PACKAGE FOR DOWN-HOLE APPLICATIONS, which claims benefit from U.S. Provisional Application No. 61/366,792, filed Jul. 22, 2011, entitled METHOD AND APPARATUS FOR PACKAGING SURFACE ACOUSTIC WAVE TRANSPONDER FOR HARSH ENVIRONMENT, the specifications of which are incorporated herein by reference.

This application is also related to U.S. patent application Ser. No. 13/188,767, filed Jul. 22, 2011, entitled SURFACE ACOUSTIC WAVE RESONATOR FOR DOWN-HOLE APPLICATIONS, which claims benefit from U.S. Provisional Application No. 61/366,784, filed Jul. 22, 2010, entitled METHOD AND APPARATUS FOR PACKAGING SURFACE ACOUSTIC WAVE TRANSPONDER FOR DOWN-HOLE APPLICATIONS, U.S. Provisional Application No. 61/366,795, filed Jul. 22, 2010, entitled SURFACE ACOUSTIC WAVE RESONATOR DEVICE FOR DOWN-HOLE APPLICATIONS, and U.S. Provisional Application No. 61/436,918, filed Jan. 27, 2011, entitled METHOD AND APPARATUS FOR PACKAGING SURFACE ACOUSTIC WAVE TRANSPONDER FOR DOWN-HOLE TOOLS, the specifications of which are incorporated herein in by reference.

TECHNICAL FIELD

Embodiments of the present invention relate to methods and apparatus for automatic monitoring of electronically tagged assets. More specifically, embodiments of the invention relate to methods and apparatus for automatic monitoring of electronically tagged down-hole assets wherein the assets travel into and out of, for example, and oil and gas well.

BACKGROUND

Oil exploration companies involved in the drilling, completion and production phases of oil and gas well installation use hundreds, if not thousands of down-hole tools such as tubulars, drill bits, mud motors, power packs, etc. while drilling, exploring and completing oil and gas wells. Some technologies have been utilized in the recent past to help such companies log individual tools into inventory; track usage of individual tools in the drilling, completion and production operations; and ultimately record the removal of individual tools from inventory when their usefulness has expired. The cost of down-hole tools is relatively high. Accordingly, it is desirable to optimally use and/or reuse many pieces of oil field equipment for subsequent drilling and development operations. However, the down-hole tools or "assets" undergo considerable stresses during drilling and completion operations. The failure of a down-hole tool generally requires the suspension of drilling operations to recover the remainder of the drill string and other related equipment. Such recovery of a drill string can be very expensive and time consuming, and thus is preferably avoided. It is also desirable to maintain complete service records relating to various pieces of oil field down-hole equipment such as, for example, drill pipe or any other down-hole equipment for the purpose of maintaining accurate and detailed records based on use, inspections, repair and maintenance, inventory, ownership or other relative criteria.

Since drilling operations usually involve the participation of a variety of workers, each having specialized skills and training, it is often not practical to dedicate a single person or a group of people to be responsible for tracking the whereabouts of individual pieces of equipment utilized during a prolonged drilling operation, or to be responsible for ensuring that each piece of equipment is regularly maintained and serviced in such a manner as to ensure that the equipment remains operationally safe.

Thus, what is needed is a method and apparatus that automatically monitors assets being tripped into and out of the wellhead of an oil and gas well.

SUMMARY

Exemplary methods and apparatus are provided for automatic monitoring of tagged down-hole assets wherein the assets travel into and out of a well. An exemplary method comprises the placement of RFID or SAW ID tags onto the assets of interest and installing such an exemplary apparatus at the location where the assets are being used. Embodiments of the apparatus may include a rig reader system, a controller interface module and a computer software system. The rig reader system may be a ring-shaped device having therein an integrated antenna array and radio frequency identification interrogators. The antenna are distributed substantially evenly about the interior of the ring surface and provide center-read coverage as assets with RFID or SAW ID tags pass through the ring-shaped device. The antenna array and interrogators of the ring reader system may be enclosed in a sealed enclosure. The sealed enclosure may be mounted directly on or below a rotary table or an oil exploration rig's floor or above the well head of an oil and gas well. An exemplary rig reader system is adapted to withstand a wide temperature range, caustic chemicals, shock and vibration that are commonly present about an oil and gas rig.

An embodiment of the invention provides an oil or gas rig down-hole asset monitoring device comprising a rig reader that comprises a ring housing portion having an inner surface, an antenna mounted to the inner surface and adapted to transmit a selected RF signal or receive a reflected RF signal from a SAW ID tag moving through a central axial area of the ring housing and an interrogator device electrically connected to the antenna and mounted on the inner surface, the interrogator adapted to produce the selected RF signal for the antenna to transmit and adapted to receive and decipher an ID data from the reflected RF signal; a controller interface module electrically connected to and distally located from the interrogator device, the controller interface module adapted to provide regulated power and control signals to the interrogator, the controller interface module being further adapted to receive the ID data from the interrogator device; and a Local Access Point (LAP) computer in data communication with the controller interface, the LAP computer adapted to provide the control signals to the controller interface and to receive the ID data from the controller interface.

An embodiment wherein the rig reader further comprises a radome covering the antenna, the interrogator and a portion of the inner surface, the radome being sealed about its edges against the inner surface.

An embodiment wherein the combination of the antenna and interrogator device are adapted to read the SAW ID tag in an amount of time being between about 5 ms and about 25 ms.

An embodiment wherein the controller interface module is distally located from about 10 feet to about 1000 feet from the interrogator device of the rig reader.

An embodiment wherein the ring housing may be mounted above a rig floor, below a rig floor or rig rotary table, or about or comprised as part of or about a rig bell nipple.

An embodiment wherein the controller interface module electrically isolates the LAP computer from the interrogator device of the ring reader.

An embodiment wherein the controller interface module is further adapted to provide the regulated power to the interrogator device of the ring reader when an asset to which the SAW ID tag is attached begins to move within the central axial area of the ring housing.

Another embodiment of the invention provides a rig reader device for reading electronic ID tags attached to down-hole assets as the down-hole assets are tripped into and out of an oil or gas well head, the rig reader device comprising an exterior housing portion that comprises a central opening extending through the exterior housing portion and along a housing axis, the exterior housing portion further comprising an inner surface, an antenna mounted to the inner surface and adapted to transmit a selected RF signal or receive a reflected RF signal from an electronic ID tag attached to a down-hole asset moving through the central opening in a direction substantially parallel to and near the housing axis, and an interrogator device electrically connected to the antenna and mounted to the inner surface, the interrogator adapted to produce the selected RF signal for the antenna to transmit and adapted to receive and decipher an ID data from the reflected RF signal; and a radome covering the antenna, the interrogator and a portion of the inner surface, the radome being sealed about its edges against the inner surface.

An embodiment wherein the exterior housing is ring shaped.

An embodiment wherein the antenna further comprising a plurality of antennae mounted about the inner surface and a plurality of slave interrogator devices electrically connected to the interrogator device and to at least to one of the plurality of antennae.

An embodiment further comprising means for mounting the rig reader to a top or bottom of a rig floor.

In yet another embodiment, a method of scanning a SAW ID tag mounted on a tagged asset as the tagged asset moves along an axial path through a rig reader mounted on an oil or gas rig is provided. The method comprising providing power from a distally located controller interface module to the rig reader after sensing that the asset is moving either axially or rotationally; initializing a microcontroller and DSP processor of an interrogator device in the rig reader; receiving process commands, by the interrogator device, from the distally located controller interface module; providing a transmit RF signal to a plurality of antennae in a predetermined switched manner, the plurality of antennae being mounted on and spaced about an inner rig reader surface positioned circumferentially about the axial path; receiving a SAW ID tag signal reflected from the SAW ID tag by at least one of the plurality of antennae; providing the received SAW ID tag signal to the DSP processor and formatting the SAW ID tag signal into SAW ID data; and sending the SAW ID data from the interrogator device to the distally located controller interface. This method wherein it is performed in a time period of between about 10 ms and 30 ms.

An additional method may further comprise receiving process commands by the distally located controller interface device, which occurs prior to receiving process commands by the interrogator device.

Yet another method wherein receiving the SAW ID tag signal reflected from the SAW ID tag is received by 3 to 4 of the plurality of antennae.

A further method wherein sending the SAW ID data from the interrogator device occurs after the SAW ID data is temporarily stored in a FIFO memory.

BRIEF DESCRIPTION OF THE DRAWINGS

For a more complete understanding, reference is now made to the following description taken in conjunction with the accompanying drawings in which.

DETAILED DESCRIPTION

Figure 1:
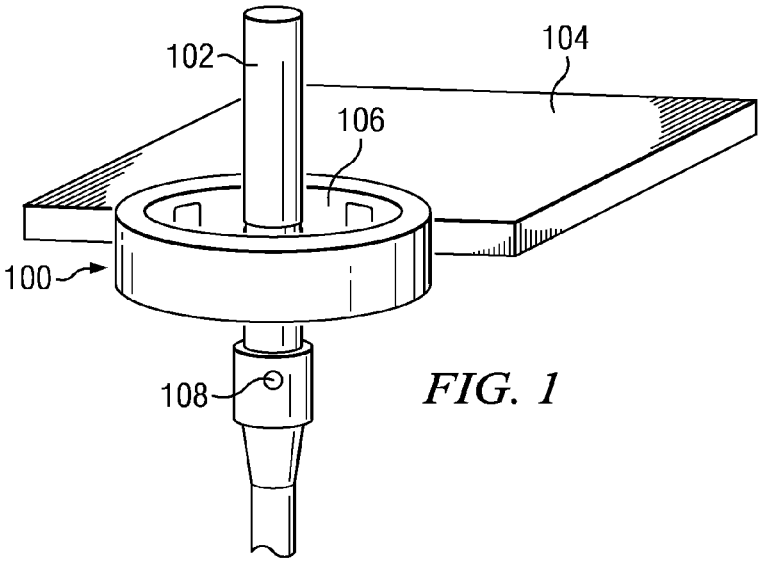
FIG. 1 is a perspective view of an exemplary rig reader mounted at or below a rig's floor and rotary table with a tagged tubular asset passing through a central location of the exemplary rig reader.

Referring now to the drawings, wherein like reference numbers are used herein to designate like elements throughout, the various views and embodiments of exemplary methods and apparatus for automatic down-hole asset monitoring are illustrated and described, and other possible embodiments are described. The figures are not necessarily drawn to scale, and in some instances the drawings have been exaggerated and/or simplified in places for illustrative purposes only. One of ordinary skill in the art will appreciate the many possible applications and variations based on the following examples of possible embodiments.

Exemplary embodiments of the present invention provide for an SAW rig reader system (RRS). An exemplary RRS may comprise hardware, embedded system firmware and software. Referring now to FIG. 1, an embodiment of the present invention comprises a rig reader 100, which provides an ability to read tagged information from a tagged asset 102 at a location below a rig floor or rotary table 104 while the tagged asset 102 is passing through a central location within the inner circumference of the rig reader 100. The inner circumference of the rig reader 100 establishes a central area or pass through portion 106. The tagged asset moves either upwardly or downwardly (while rotating) in an axial direction with respect to the circumference of the rig reader 100. The tagged asset 102 passes through the pass through portion or central area 106 during, but not limited to, drilling, tripping in tubulars and tripping out tubulars or any other down-hole asset as illustrated in FIG. 1. An exemplary rig reader 100 may be mounted below the rig floor 104 or rotary table of a drilling rig (not specifically shown). An asset of interest 102 is tagged with a transponder or resonator 108, which comprises, but is not limited to the technology of surface acoustic wave (SAW) and radio frequency identification (RFID) devices.

Figure 2:
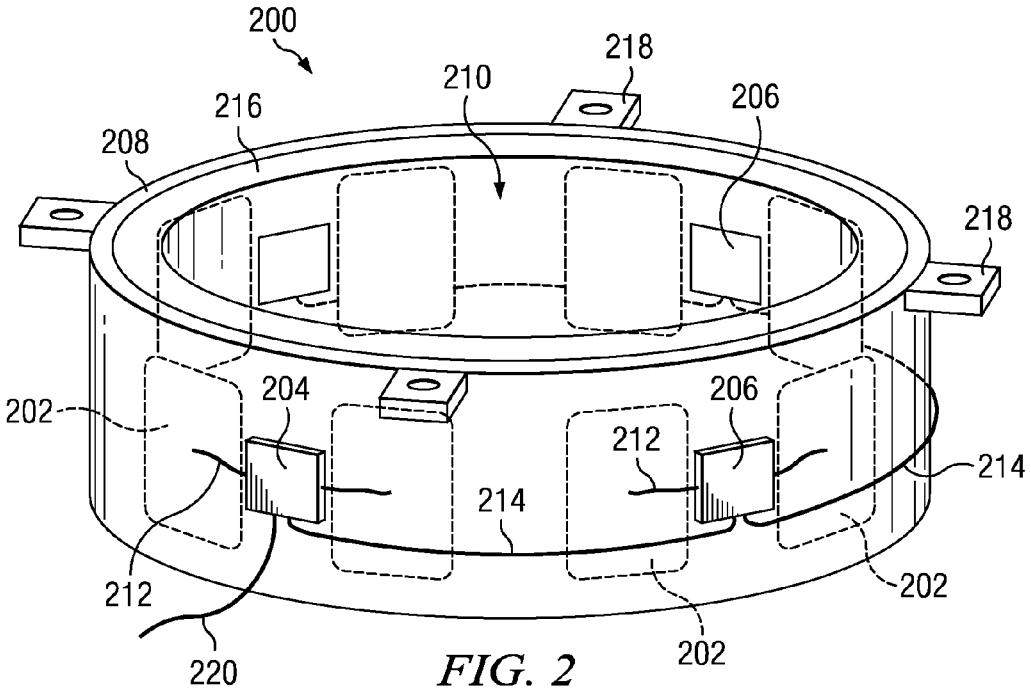
FIG. 2 is a perspective view of an exemplary rig reader.

FIG. 2 illustrates an exemplary circular rig reader 200, which comprises eight antenna 202, a master interrogator device 204, and one or more slave interrogators 206. The antennae 202 are positioned about the interior surface circumference of a metal alloy cylindrical exterior ring 208. The exterior metal alloy ring 208 may also be referred to as the rotary pan or bell nipple housing, but in some embodiments the exterior metal ring 208 may not be part of the drill rig and is constructed separately. The antennae 202, which are positioned about the interior surface of the metal ring housing 208 are spaced to established contiguous read and transmit coverage about the central access of the central area 210 within the inner circumference of the rig reader 200. A master interrogator 204 or slave interrogator 206 connects to one or more of the antennae 202 via antenna cables 212. The master interrogator 204 orchestrates the reading sequence for itself and each of the other slave interrogators 206. The orchestration of the reading sequence for the master interrogator 204 and other slave interrogators 206 comprises a read timing and a read duration, a frequency channel and phase, and a radio frequency transmission power level. The master and slave interrogators 204, 206 are connected by a multi-conductor cable 214 that comprises power supply connections, command wires, and data communication wires.

The exemplary casing or exterior metal ring housing 208 of an embodiment may comprise a cylindrical metal alloy ring having a feed through central area 210 within its circumference. A radio frequency transparent radome 216 covers the interior circumferential surface of the metal ring housing 208 such that the radome 216 covers the antenna 202, the master and slave interrogator devices 204, 206 and the antenna cables 212 and multi-conductor cable 214 connected thereinbetween. The metal alloy ring housing 208 has a high degree of resistance to corrosive chemicals such as those found at oil and gas will heads. The metal alloy ring housing 208 also has a high thermal conductivity to aid heat dissipation from the various internal components (i.e., the interrogator devices 204, 206 and in some situations the antenna 202). The radome housing 206 is sealed at least at an upper circumferential location of the interior of the metal ring housing and a lower location of the interior metal ring housing to form an exemplary ring reader enclosure of about the devices encased between the radome housing 216 and the interior surface of the metal ring housing 208. In some embodiments the ring reader's external metal ring housing 208 may have flanges 218 attached thereto as depicted in the figure at the top, bottom or central edge of the exterior metal ring housing 208. Each flange 218 may have a fastening hole for bolding an exemplary rig reader 200 to a top or bottom surface of a rig platform such that the drill stem travels through a central axial area within the pass through central area 210 within the circumference of the rig reader 200. It is understood that a means for mounting an exemplary rig reader to the underside of, near or below the floor of a rig can take a variety of different form factors, shapes and configurations that may include, without limitation, various types of mounting brackets, latching brackets, clip-on constructs, or other removably attachable or non-removable mechanisms, support or suspension structures positioned to mount an exemplary rig reader 200 above, below or about the rotary table or bell housing nipple, or in other embodiments between the top of the rig floor and the well head of an oil or gas well. A data and power connection cable 220 connects an exemplary rig reader 200 to a controller (not specifically shown) and a local access point (LAP) or host computer (also not specifically shown in this figure).

Figure 3:
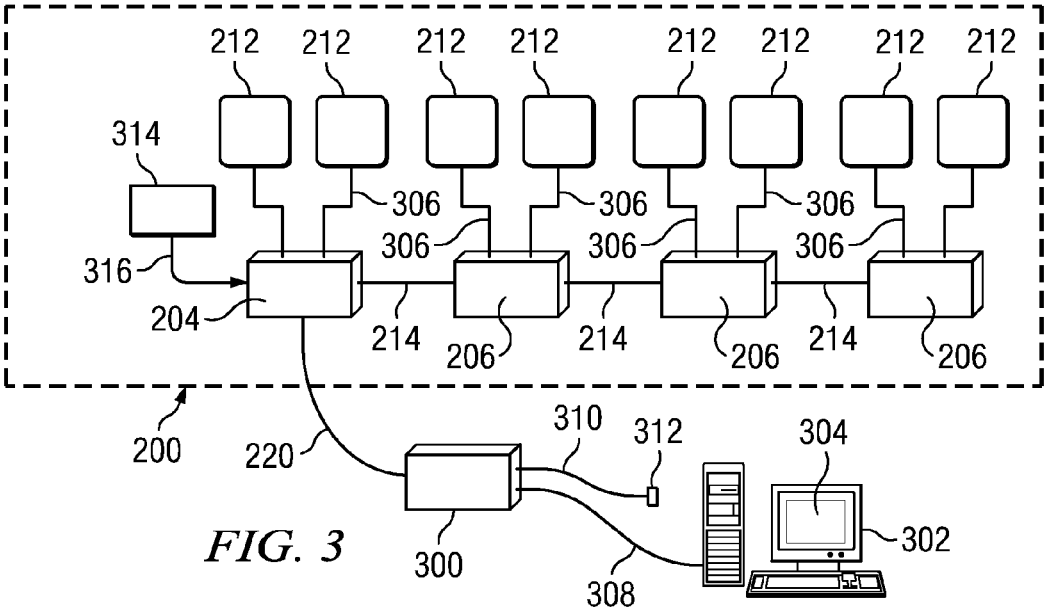
FIG. 3 is an exemplary conceptual view of the connections of the various rig reader components in accordance with an embodiment of the invention.

FIG. 3 depicts an exemplary conceptual view of the interconnectivity of the antenna 212, master interrogator 204, slave interrogators 206, controller interface module 300, and a host computer or LAP 302 that comprises exemplary software and a user interface 304. Each exemplary master or slave interrogator 204 and 206 may connect to one or more antenna 212 in a mono-static or bi-static configuration via antenna cables 306. In a mono-static configuration, each antenna 212 is configured via the interrogators 204, 206 to transmit and receive radio frequency energy. Conversely, in a bi-static configuration, each antenna 212 is designed to be either for transmitting or for receiving information from or for the master or slave interrogator 204, 206 that it is connected to. The plurality of antenna 212 collaboratively create a contiguous radio frequency coverage about the center of the hole area 210 where the drilling string and tagged assets pass either in a downward or upward direction near the central axis of the rig reader 200. This is important, because the tag may be rotating and/or facing any radial direction from the central axis of the rig reader and thus must be read by one or more antenna as it moves either upwardly or downwardly along the axis while also rotating.

The controller interface module 300 may have various exemplary functions. The controller interface module 300 is connected by the data and power cable 220 to the master interrogator 204. The controller 300 is further connected, via data cable 308 to the computer LAP 302. Furthermore, the controller 300 is connected by the power cable 310 to a power source 312. The controller 300 controls the rig reader 200 to turn on or turn off in order to start and stop a reading process. In some embodiments the rig reader further includes a motion detection device 314, which senses whether the drill string is moving in an upward or downward direction and/or rotating. When the drill string is not moving upward, downward or rotating, the motion sensor device provides such an indication via connection 316 to the master interrogator 204, which may shut down or turn off the transmission of RF signals from the antennae 212. The master interrogator 204 communicates with the slave interrogators via multi-conductor cables 214. When the master interrogator starts, the rig reader's tag reading process, the controller 300 collects and buffers data received from tags read by the rig reader. Such data includes RFID or SAW identification indicia received from an RFID transponder or SAW transponder 108 installed in an asset of the drill string. In some embodiments, the controller interface module also receives an indication of whether the identification indicia of the asset is moving upward out of the well head or downward into the well head. Additionally, in some embodiments the controller interface module 300 may perform data validation, smoothing, consolidating, date and location stamping and inclusive error rejection functions on the tag identification indicia data received from the master interrogator 204. The controller 300 may further send the collected and processed data received from the rig reader to the designated host computer LAP 302 that has the interfacing software and user interface system 304 installed therein via data cable 308. Power 312 for powering the controller interface module 300 and rig reader 200 is provided from the power source 312 by power cable 310 to the controller 300 which may comprise power circuitry to adjust the incoming power to a voltage and current required by both the controller 300 and the rig reader 200. In some embodiments, the power source 312 is supplied to the controller 300 in response to a remote power sensing device, which senses when power is being applied to the machinery that rotates and moves the drill stem up and down into an out of the well head. As such, the power source will provide an indication to the controller 300 as to whether the drill stem is moving and an indication of whether the drill stem is moving upward or downward.

Figure 4:
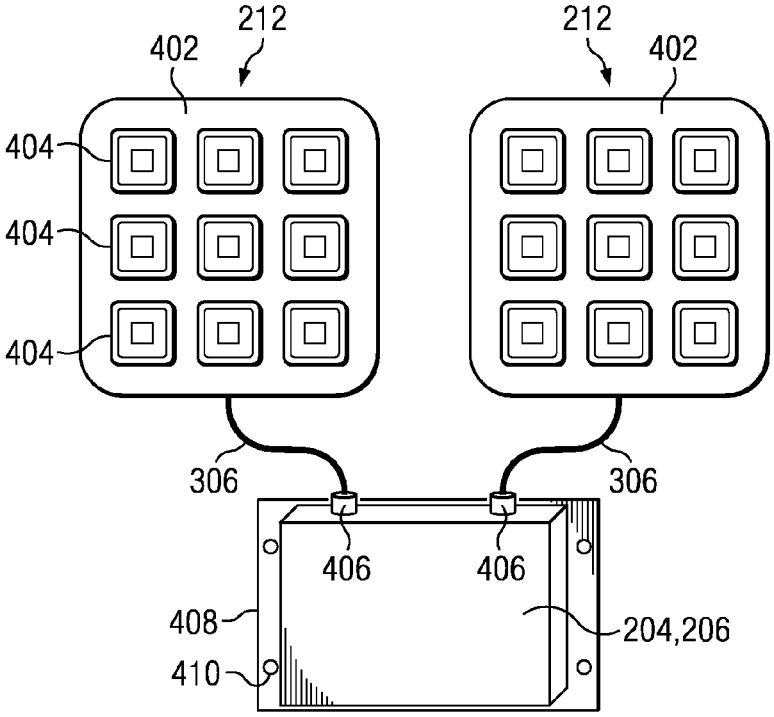
FIG. 4 is a view of an exemplary antenna array and rig reader interrogator module in accordance with an embodiment of the invention.

FIG. 4 illustrates an exemplary master interrogator 204 or slave interrogator 206 connected to two antennae 212 via antenna connection cables 306. The exemplary antennae 212 comprise an antenna substrate 402 and a plurality of antenna elements 404. Antenna elements 404 form arrays adapted to focus radio frequency energy toward and to receive radio frequency from the center axis area 210 of an exemplary rig reader. The antenna elements 404 focus frequency energy toward and receive frequency energy from the center axis area 210 of the rig reader so that assets that have tags (i.e., identification tag 108 of FIG. 1) that are traveling through the central axis area 210 will be successfully scanned by the plurality of the antenna 212. Antenna elements 404 may be networked together on each antenna 212. The antennae elements 404 may each be connected to a respective master or slave interrogator 204, 206 via antenna cables 306 and antenna connectors 406. The master and slave interrogators 204, 206 comprise a thermo conductive metal base 408 with mounting holes 410 so as to allow the master or slave interrogators 204, 206 to be mounted against the interior circumferential surface of the metal ring housing 208. Mounting of the master and slave interrogator devices 204, 206 such that their thermo conductive metal bases 408 are against the inner circumferential surface of the metal ring housing 208 enhances the transference of heat from an interrogator 204, 206 to the metal ring housing 208 to which it is attached. In some embodiments, conductive grease may be between the thermo conductive metal base 408 of the master and slave interrogators 204, 206 and the inner circumferential surface of the metal ring housing 208 to increase thermo conductivity therebetween.

Figure 5:
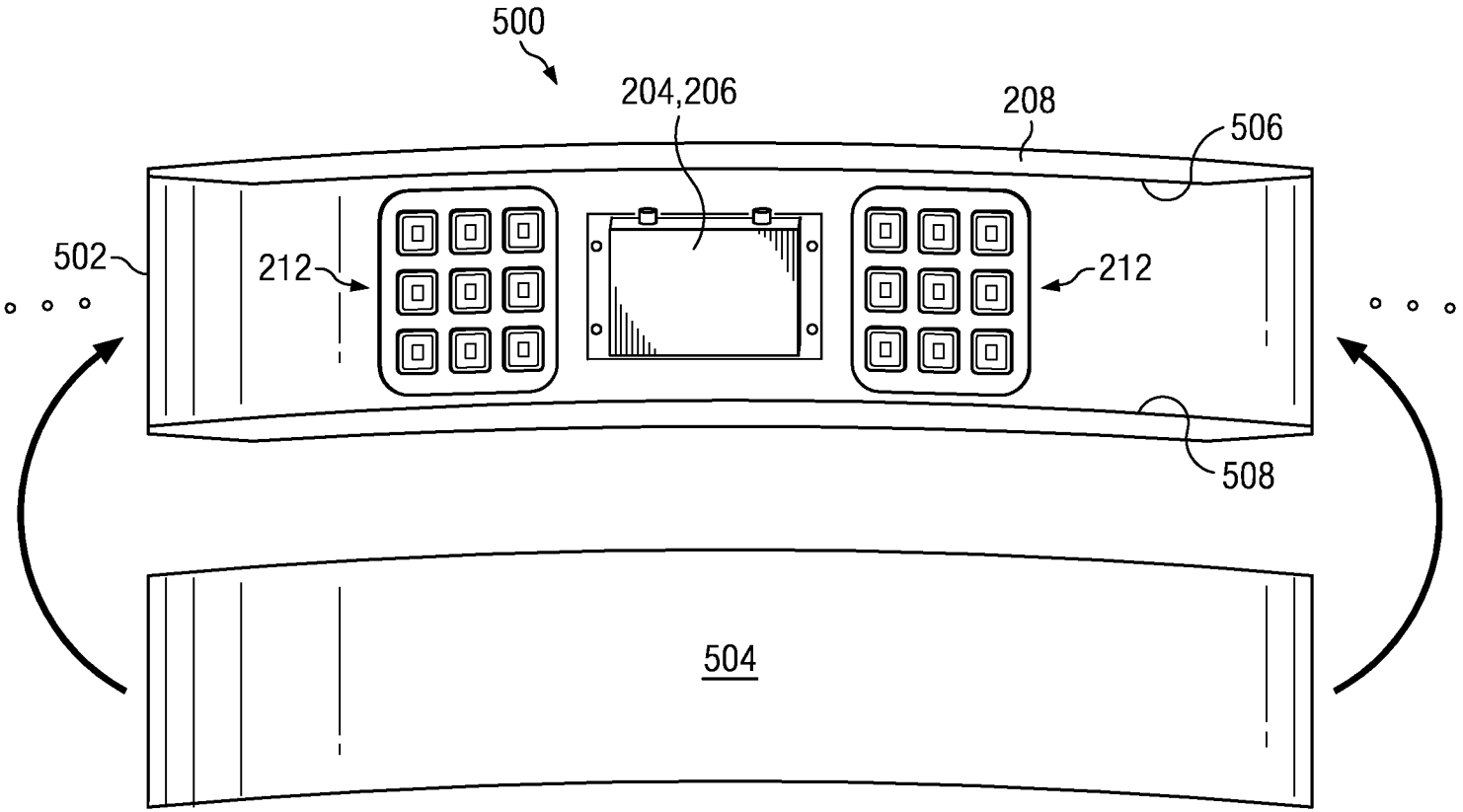
FIG. 5 is a perspective view of a section of an exemplary ring rig reader.

Referring now to FIG. 5, an exemplary rig reader section 500 is depicted. The section of the cylindrical exterior metal ring housing 208 shows the inner circumferential surface 502 of the metal ring housing. A master or slave interrogator 204, 206 is mounted to the inner circumferential surface 502 between two exemplary antennae 212. A radio frequency transparent radome attaches near a top portion 506 and bottom portion 508 of the inner circumferential surface 502 of the metal ring housing 208. The metal ring housing inner circumferential surface 502 and the upper 506 and lower 508 portions together with the radome covering 504 form a sealed enclosure that is adapted to protect the internal components of an exemplary rig reader from elements commonly present at or around an oil or gas well head. Of course, such enclosed elements include the antenna 212, the master and slave interrogators 204, 206 and the related cabling (not specifically shown in FIG. 5).

Figure 6:
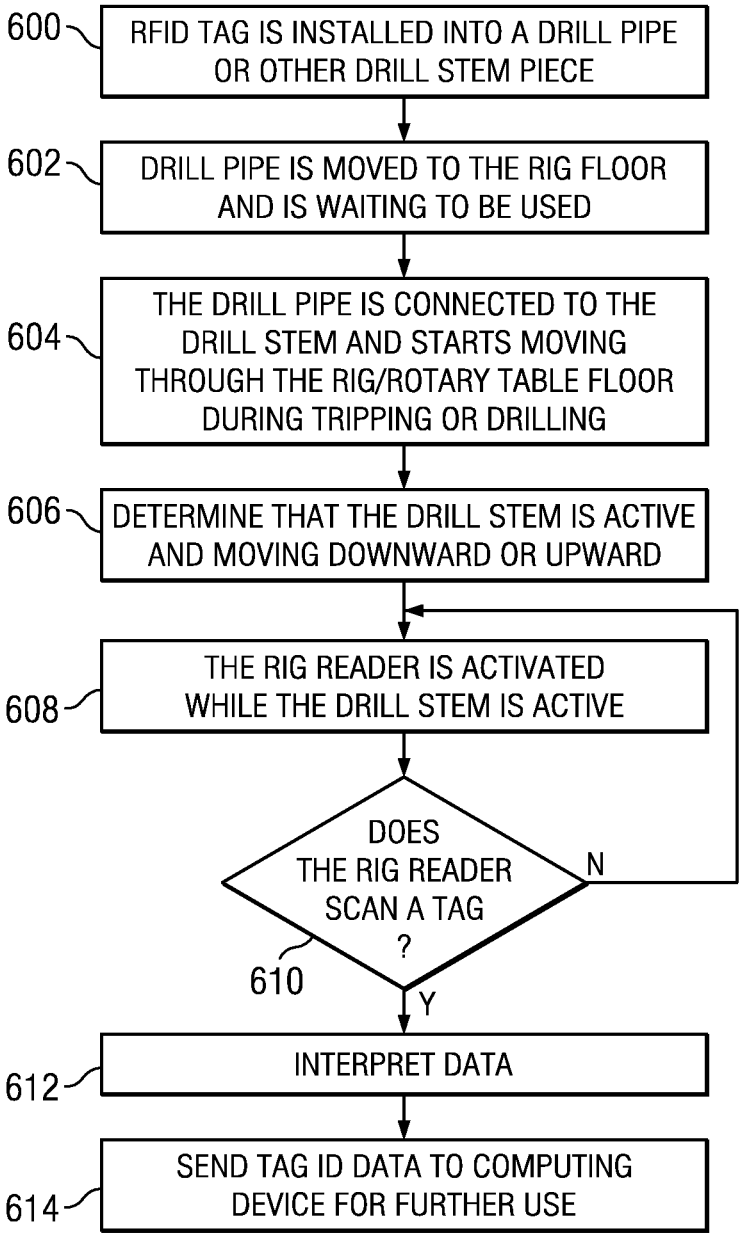
FIG. 6 is an exemplary method of down-hole asset monitoring in accordance with an embodiment of the invention.

Referring now to FIG. 6, a flow diagram of a method for automatic down-hole asset monitoring is shown. At step 600, an RFID or SAW identification tag is installed into an asset such as a tubular, drill bit, mud motor or other drill stem device used in down-hole oil and gas drilling. At step 602, the asset drill pipe is moved to the rig floor waiting to be tripped or installed onto the top end of the drill stem. At step 604, the asset drill pipe is connected to the top end of the drill stem and starts moving through the rig floor or rotary table. At step 606, a determination is made as to whether the drill stem is moving in a downward (toward the well head) direction or and upward (toward the drilling rig) direction. The direction and movement is sensed by an exemplary rig reader and/or automatic down hole asset monitoring system, such that at step 608 the controller for the rig reader activates an exemplary rig reader to scan for SAW ID tags while the drill rig is active. At step 610 a determination is made as to whether or not a tag is scanned. If a tag is not scanned, the method loops back to step 608. If a tag is scanned at step 610, then at step 612 the identification data indicia from the SAW identification tag is read by one or more of the rig reader antennas and provided, via the slave and master interrogator devices, to the controller interface module. The controller interface module collects and buffers the identification data from the rig reader and may perform data validation, smoothing, consolidation, date and location stamping, direction (i.e., upward, downward direction stamping) and error rejection functions on the received identification data. After the identification data from the SAW tag on an asset is passed through interpreted by the controller, it is provided in step 614 as a tag number along with perhaps other information including time stamp, directional information and other reader information to a computing device LAP for asset management.

In additional embodiments of the invention, an exemplary rig reader system or automatic down-hole asset monitoring apparatus is separated into three key sub-systems. The three sub-systems being the rig reader portion, a controller interface module, and a local access point LAP or host computer. An exemplary rig reader includes an integrated GEN 2 SAW reader with a 360° antenna system mounted against an inner surface of a ring shaped enclosure. An exemplary GEN 2 SAW reader and antenna system is adapted to read GEN 2 SAW tags. An exemplary system supports an autonomous read mode, which continuously scans for tags within the inner hole or pass through area of an exemplary ring rig reader after receiving a start command from the LAP or host computer. If the data or communication connection between the rig reader and the LAP is busy or is processing configuration or control commands from the LAP, the master interrogator of the rig reader or, in some embodiments, the controller interface module is adapted to buffer the SAW identification tag information using a FIFO method. The rig reader is further adapted to filter the tag information and return unique tag identification data and/or only tag data for those particular tagged assets that the LAP is interested in receiving. In some exemplary embodiments, the tag reading process of the rig reader is given a higher priority than the command processing of the controlling device and/or LAP device in order to guarantee a fast read cycle at start-up and at the moment the scanning process is terminated due to a stop in movement of the drilling stem so that the chance of missing a tag that should be read is minimized.

An exemplary rig reader may be equipped with a 100 Base-T Ethernet communication between the interface modules of the rig reader and the controller device. The 100 Base-T Ethernet connection is adapted to support standard Ethernet protocols including TCP/IP, DHCP, and NTP. If the NTP protocol is used, it allows the rig reader to synchronize the master and slave interrogator device's internal clocks with a centralized time server provided by either the controller or the LAP.

An exemplary controller interface module has two major functions. One function is to provide remote power regulation to the circuitry within the rig reader. The other major function is to boost the data signal provided from the master interrogator of the rig reader because the distance between an exemplary rig reader and a LAP computer may be long enough that attenuation of a signal or data could become problematic.

With respect to remote power regulation provided by the controller interface module, high voltage is converted to a regulated lower voltage, which is provided to an exemplary rig reader. By running the rig reader on a lower voltage some hazardous risks may be avoided. Furthermore, by providing switching power regulation at the controller, noise and interference that would be produced by performing switching power regulation within the rig reader is avoided. Additionally, additional heat generation or build-up, which is a byproduct of power regulation, does not have to be dissipated from the rig reader since the switching regulation is done in the external controller interface module. Finally, an exemplary controller interface module may comprise a circuit and cabling adapted to perform remote voltage sensing at the rig reader in order to compensate for any voltage drop through a long cable run between the controller interface module and the rig reader so as to maintain the correct voltage needed at the rig reader. Exemplary embodiments that provide this two-tier configuration (rig reader and separate distally connected controller interface module) adds flexibility to the installation of an exemplary system and further helps to minimize noise, interference from other signals and heat dissipation requirements in the rig reader as well. An exemplary controller interface module further provides communication isolation between an exemplary rig reader and the LAP via optical couplers which help to protect the rig reader electronics, and in some embodiments the LAP computer, from potentially damaging static discharges and power surges. Some embodiments of an exemplary interface module are adapted to boost the data signal for longer cable runs of up to 1,000 feet wherein standard configurations of an exemplary controller interface module support distances of up to about 328 feet.

A LAP computer of an exemplary rig reader system or automatic down-hole asset monitoring system may be a standard personal computer or the like that is equipped with a 100 Base-T Ethernet port and sufficient resources for running reader manager software or other necessary software for asset management. The LAP interfaces with the rig reader via the controller interface module using standard 100 Base-T Ethernet communication. Rig reader manager controls and processes are all communicated to and from the rig reader via the controller interface module, but originate from the LAP computer.

Figure 7:
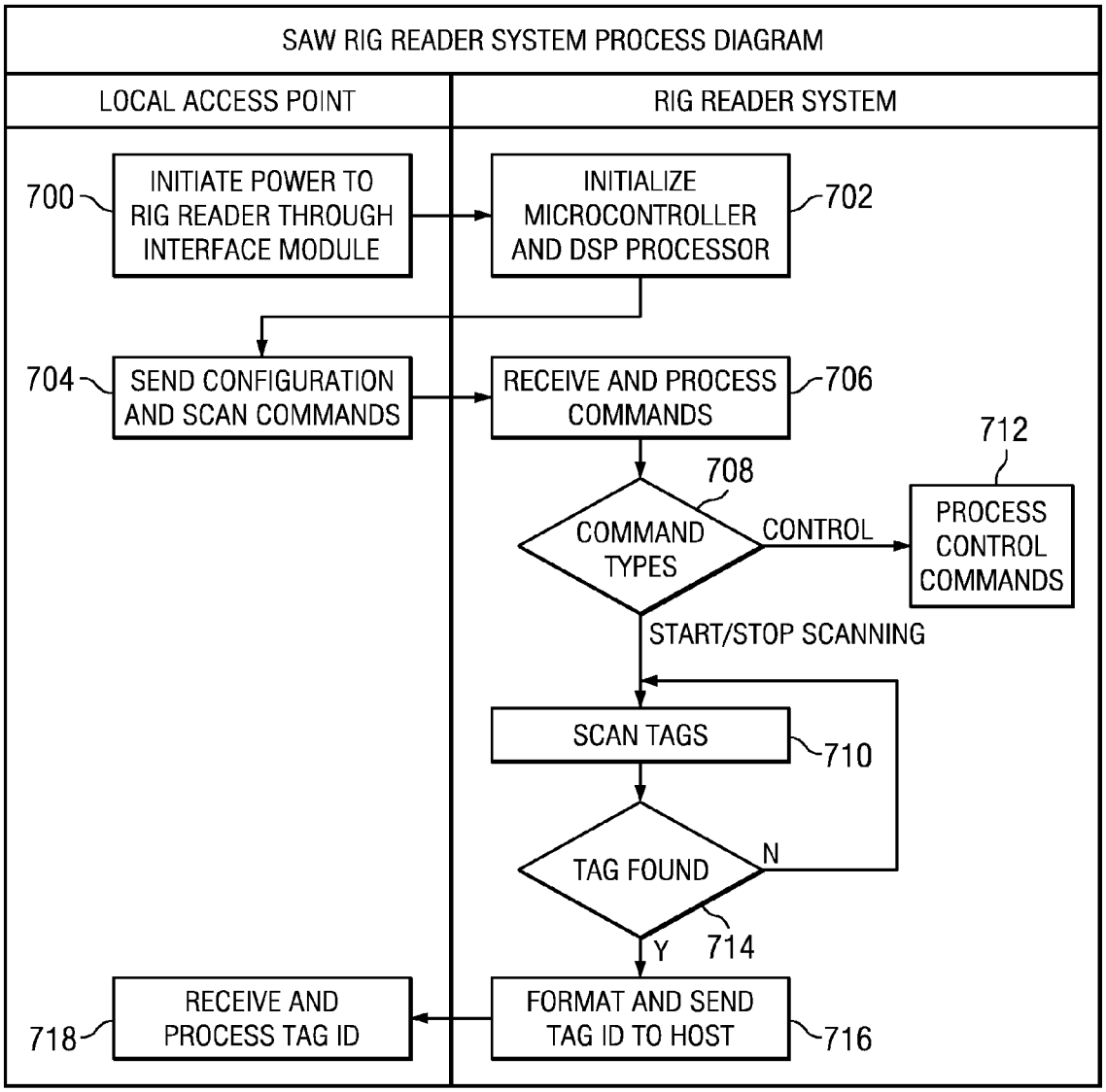
FIG. 7 is a flow chart that provides an exemplary SAW rig reader process diagram in accordance with an embodiment of the invention.

Referring now to FIG. 7, a flow chart is provided that shows the basic interactions between an LAP computer and an exemplary rig reader system. When power is applied to an exemplary interface module, the interface module converts and sends the appropriate regulated power to the rig reader. At step 700, power is initiated to the rig reader through the interface module and starts an initialization process of a microcontroller and DSP processor within the master and slave interrogator devices in an exemplary rig reader at step 702. After initialization, the rig reader is put into a standby mode and waits for further instructions from the LAP computer. At step 704, the LAP computer sends configuration commands to the rig reader system to configure the appropriate parameters. Such parameters are received at step 706 by the rig reader system. The types of parameters received may comprise antenna configuration, antenna switching speed, RF channel frequency, and other pertinent information.

If at step 706 the rig reader received a start-scanning command, then the rig reader system moves through step 708, where it's determined that a scanning command was received, and begins to scan tags in an autonomous mode based on the current configurations and parameters provided by the LAP computer. While scanning tags at step 710, the rig reader firmware continuously checks at step 708 for control commands being received from the LAP computer between each tag reading cycle. When a control command is received at step 706 and determined to be present at step 708, the rig reader firmware processes the control command at step 712 at a lower priority than the tag scanning process of step 710. After completing any control command updates, the tag scanning process will pick up the new configuration during a next read cycle.

During the tag scanning process, if no tag is found at step 714, the rig reader continues to autonomously scan for tags, but if a tag is found at step 714, the rig reader reads the identification indicia or data from the SAW device and formats such indicia or data at step 716 and sends the formatted data to the LAP computer at step 718. If, for some reason, communication is busy or interrupted between the LAP computer and the rig reader system, for example, due to a process control command being sent on the data lines, the master interrogator device of the rig reader may buffer the received and formatted tag data using a FIFO format and then resend such data after the communication data line between the rig reader and the LAP computer is opened and communication can be resumed. When the FIFO buffer is full, the least current SAW tag identification data will be discarded. An exemplary FIFO buffer within an exemplary rig reader and/or master interrogator device should be large enough to hold hundreds, if not thousands of tag ID indicia with time stamps and directional indicator data so that if the LAP computer is locked-up, asset management information about down-hole assets will not be lost while the LAP computer is rebooted and comes back online.

The exemplary technology for ID tags used in conjunction with an exemplary rig reader system or automatic down-hole asset monitoring system, in some embodiments, will be surface acoustic wave (SAW) technology that is compatible with GEN 2 SAW designs. Embodiments may be tailor made for world wide oil and gas drilling rig operations wherein the universally accepted frequency band for SAW ID tags is 2.4 GHz ISM band. Additionally, embodiments may be compliant with FCC part 15 and ETSI 300-440 for operation in U.S. and Europe.

An exemplary rig reader's performance plays a significant role in accurate oil and gas drilling asset monitoring operations. Due to the harsh environments and caustic chemicals that may spill a variety of RF dampening chemicals on the radome portion of an exemplary rig reader, as well as stray RF noises, a good performance transmitter and sensitive receiver are important to a successful implementation of an exemplary automatic down-hole asset monitoring system. As such, the transmit and receiving capabilities of an exemplary antenna system and interrogator device within an exemplary rig reader shall be adapted to read a SAW identification tag in a far field read of 5 to 10 meters. The rig reader antenna and interrogator device systems of an exemplary embodiment shall have a near field read range to be greater than 0.5 meters when RF dampening material such as caustic liquid, sea water, mud, oil, drilling chemicals, etc. are coating the surface of the radome that covers the exemplary rig reader's antenna system. Furthermore, exemplary embodiments may accomplish the maximum allowable transmit RF output of about 4 watts EIRP so as to generate from about 25 to 40 dBm with firmware controllable gain ranging from 10 dBm to the maximum power with 1 dBm steps therebetween.

An exemplary reader shall further be adapted to have a read/receive sensitivity of at least −80 to −100 dBm, 50 ohm of antenna matching impedance, and more importantly, the entire read cycle of a SAW identification tag must take less than 20 ms and preferably about 10 ms. To be more clear, a read cycle time is getting a first read command from the LAP computer to the rig reader to the return of a tag ID data to the LAP computer. If there is technical difficulty to achieve a specified read rate of less than 20 ms, then an internal buffer within the master interrogator, other component of the rig reader or the controller interface module will store the SAW ID data from each read cycle performed by the rig reader during multiple read cycles for later LAP host computer retrieval. This buffering approach will decouple the read process and the host LAP interface, but when operating in autonomous mode, the exemplary rig reader is easily adapted to process the reading of the tags within the speed rate requirement of about 10 ms per read cycle to at most 20 ms per read cycle.

In some embodiments a SAW ID tag early detection methodology is utilized to determine whether a SAW ID tag embedded in an asset is present in the read field (inside the interior or read area of an exemplary rig reader) prior to initiating and/or completing an entire interrogation process. If it's determined that a tag is not present, the interrogation of the tag should terminate immediately so as to be ready for a next read cycle when a SAW tag may be present. This exemplary approach greatly improves the read rate by reducing the time of attempting to read a non-tag or non-functioning tag to less than about 10 ms.

When exemplary embodiments are used for oil and gas asset tagging, a minimum of 32 bits should be used as a tagged ID length so as to handle up to about 4 billion unique SAW ID tags. Additionally, the SAW ID tag bit length may comprise additional bits designated as header bits. The header bits may allow the flexibility of assigning a certain group of SAW tags to different customers or industries, or simply be used for security and control purposes. As such, exemplary embodiments should be adapted to read SAW ID tags that comprise 8 to 16 bits as header bits in addition to 32 to 64 bits used as an identification code.

Additionally, embodiments comprise an anti-collision firmware in the rig reader. The anti-collision requirement in firmware is not necessarily needed for reading multiple ID tags in a single read cycle, but instead is utilized for reading an intended ID tag even if other ID tags are present within or near the read field during a given read cycle. In such a situation, an exemplary rig reader may (1) be adapted to read all the ID tags in the read field or (2) simply read the ID tag with the strongest return signal based on the tag with the strongest signal is probably the tag that is intended to be read. Due to the general storage layout of tubular assets on an oil or gas drilling rig, the anti-collision firmware within the rig reader must be of the type that allows the rig reader to anti-collide 2 to about 75 ID tags in a single read cycle. Thus, an exemplary rig reader is adapted to handle the anti-collision for up to about 75 tags located anywhere within the proximity of the target read area of an exemplary rig reader.

Because an exemplary rig reader system or automatic down-hole asset monitoring system may be used at virtually any oil field in the world, the exemplary required operating temperatures for an exemplary rig reader and/or controller interface module are within a range of about −40° C. to about 85° C. With respect to shock and vibration, an exemplary rig reader is expected to operate in harsh environments with vibration of up to 30 g sine sweep at 5 Hz to 2000 Hz and 100 g at 11 ms ½ sine shock. Other exemplary embodiments may be adapted to operate in a vibration of 50 g sine sweep at 5 Hz to 2000 Hz and 200 g at 11 ms ½ sine shock.

The actual dimensions of an exemplary rig reader may vary from model to model, but may be installed on up to about 90% or more of both land and ocean oil and gas drilling rigs such that the exemplary rig reader can be mounted on top or below the rig drill floor or outside the bell nipple of the drilling rig.

Due to the harsh environments, which oil and gas rigs are located in, an exemplary radome that attaches to an exterior metal ring housing of a exemplary rig reader should be adapted to be hermetically sealed thereto so as to keep contaminants out from between the radome and the inside circumferential surface of the metal ring housing where the antennas, master and slave interrogator devices are mounted. Furthermore, the exterior of the metal ring housing should be positioned to enable heat dissipation through a heat sink and/or exposure to outside air via ventilation. The exterior of an exemplary metal ring housing of a ring reader and/or the heat sink thereabout may be manufactured of metals and/or coated with other materials that resist caustic chemicals such as sea water, hydrogen sulfide, carbon dioxide, nitrogen, bromine, chloride, and drilling fluids.

Figure 8:
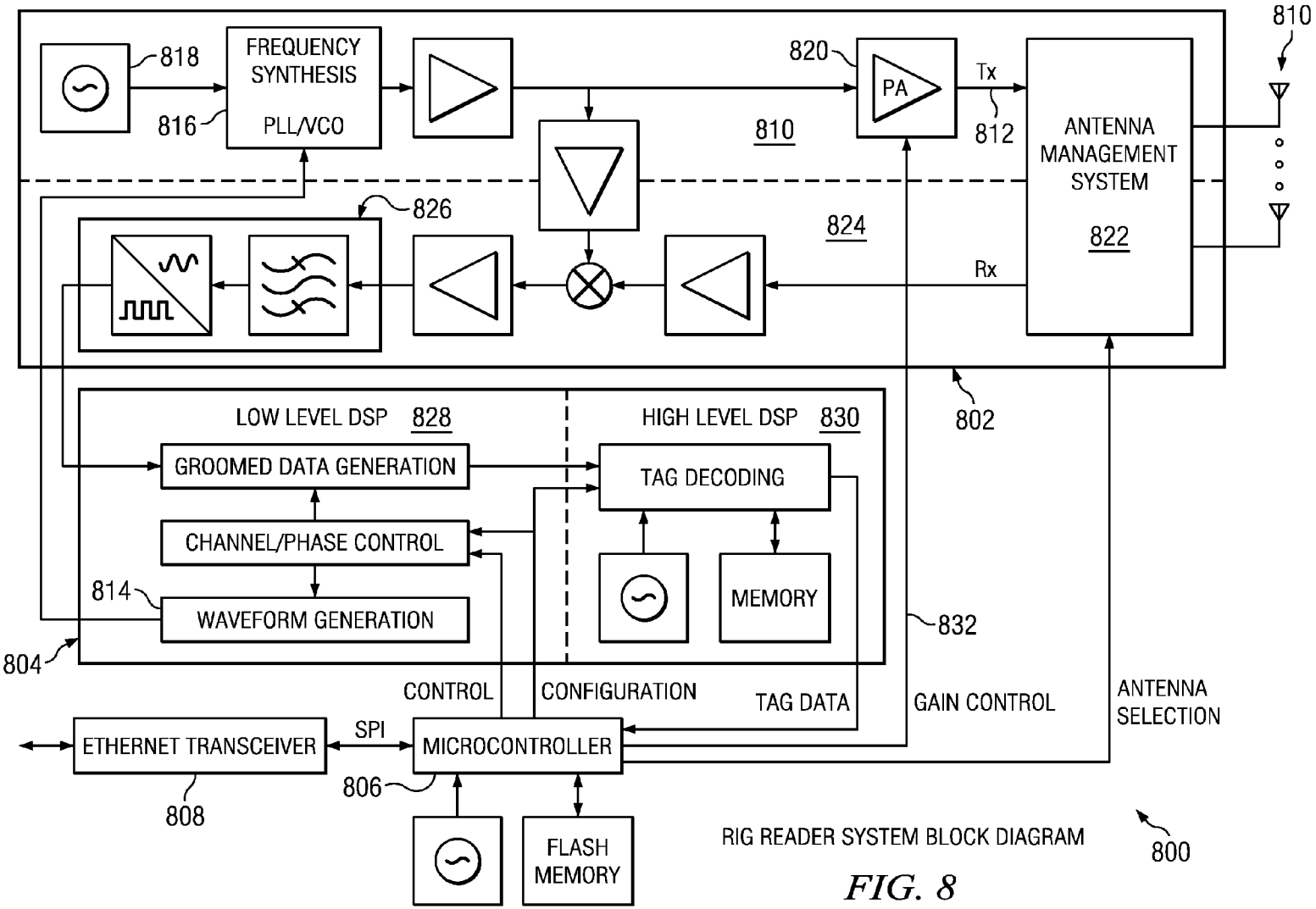
FIG. 8 is a block diagram of an exemplary rig reader device.

Referring now to FIG. 8, a block diagram of an exemplary SAW rig reader 800 in accordance with an embodiment of the invention is provided. The rig reader 800 comprises an RF transceiver 802, a digital signal processor (DSP) 804, a microcontroller 806, an Ethernet transceiver 808, and an antenna system 810. The RF transceiver 802 comprises an RF transmitter portion 810 that generates an RF signal 812 based on a generated waveform provided from the low level DSP waveform generator 814. The generated waveform is modulated by the frequency synthesizer 816 with the carrier frequency provided by a frequency generator 818. In various exemplary embodiments the carrier frequency may be 2.4 GHz ISM band. The synthesized signal is then amplified by a voltage controlled power amplifier 820 from about 10 dBm to about 36 dBm in one dBm incremental steps. The RF signal 812 is sent via the antenna management system 822 to one or more selected antennas in the antenna system 810 for transmission. This design can generate 4 watts EIRP output with up to about 6 dBm watts due to cabling, antenna switching, and the use of a low or no gain antenna, which is permitted by FCC PART 15. In addition, on the receiving side of the RF transceiver 802, field programmable gate array (FPGA) filters 826 are recommended in exemplary embodiments to dynamically filter the return signal that is reflected and provided from the SAW ID tags. This enables efficient filtering capability and provides an exemplary rig reader system a programmable capability to adapt to the intended range or channels that are to be used in any particular exemplary system.

The DSP block 804 comprises a low-level DSP portion 828 and a high-level DSP portion 830. The low-level DSP portion 828 generates specific waveforms via the waveform generator 814, within that are used to interrogate SAW ID tags. The low-level DSP portion 828 further processes the returned or received waveform according to the intended phase and channel for lowering the noise floor of the signal and for anti-collision processing. The high-level DSP portion 830 applies mathematical and statistical models to the received waveform in order to decode the tag ID data or information received from the SAW ID tag.

The microcontroller 806 handles managerial tasks and hosts communication functionality between the rig reader and the LP computer. Some of the tasks that an exemplary microcontroller 806 performs within an exemplary interrogator device and/or exemplary rig reader include controlling what channel and/or phase that is to be used for each read cycle by directly interfacing with the DSP processor 804. The microcontroller further manages configuration data used by both the low-level and high-level DSP portions 828 and 830 of the DSP block 804. The microcontroller 806 pay also provide a gain signal 832 that is provided to the power amp 820 so as to control the gain of the power amplifier from 8 dBm to about 36 dBm. Via the Ethernet transceiver 808, the microcontroller 806 processes commands received from the LAP computer, which include, but are not limited to, signal manufacturing commands, rig reader configuration commands, and rig reader operation commands. The microcontroller also pushes the deciphered SAW tag ID messages or data via the Ethernet transceiver 808 to the LAP computer when operating in autonomous modes. It also notifies the LAP computer with error messages and/or with diagnostic results. The microcontroller 806, upon power being provided to the rig reader by the controller interface module, boots the firmware of an exemplary rig reader; and when requested performs a DSP code upgrade. The microcontroller 806 processes and updates configuration data provided from the LAP computer, such as pseudo-random frequency tables, power level tables, DSP parameters, antenna switching sequence selections and tuning parameters, just to name a few.

The Ethernet transceiver 808 converts between Ethernet and SPI protocols. The Ethernet transceiver further comprises a buffer and Ethernet stack to handle messages asynchronously. Optionally, in some embodiments the Ethernet transceiver 808 can boost the data signal provided from a master interrogator device to a controller interface module so the data signal will not attenuate completely over a long cable run of up to about 1000 feet.

Figure 9:
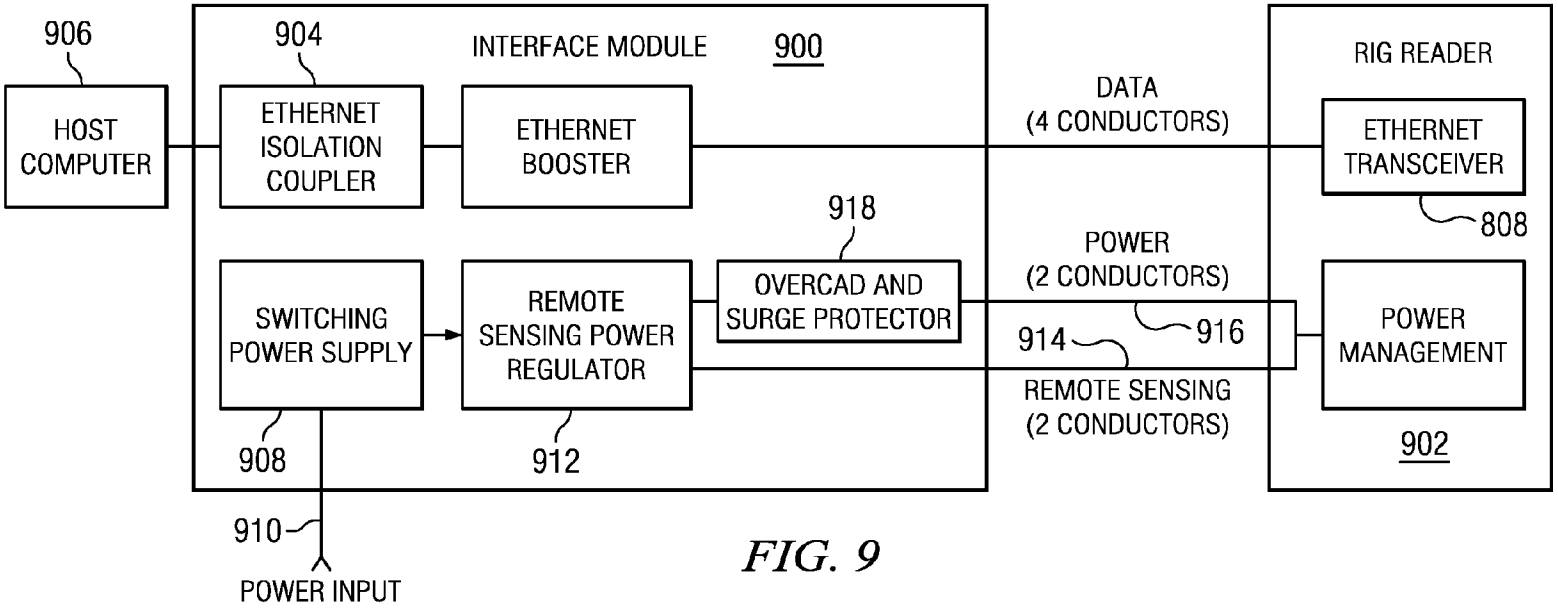
FIG. 9 is a block diagram of an exemplary controller interface module.

Referring now to FIG. 9, an exemplary block diagram of a controller interface module 900 shows the interface module's operations in relation to a rig reader 902. An exemplary controller interface module 900 may include data communication handler circuitry, isolation circuitry and protection circuitry. The Ethernet isolation coupler 904 isolates the Ethernet connection between the controller interface module 900 and the LAP host computer 906. Furthermore, the Ethernet isolation coupler 904 isolates the LAP computer 906 from the rig reader 902 in order to minimize or prevent noise, power surges and static discharge problems. Thus, power provided to the pre and post isolation couplers (the isolation coupler 904 shown and isolation coupler in the LAP computer 906 not specifically shown) will be separated. The rig reader 902 comprises an Ethernet transceiver that, as discussed above, has the capability to include Ethernet boosting circuitry to support longer cable runs between a rig reader and a controller interface module 900 for up to about 1000 feet. Without the Ethernet boosting circuitry an exemplary standard configuration of the rig reader Ethernet transceiver 808 supports transmission over cable distances of up to about 328 feet (about 100 meters).

The primary switching power supply 908 converts a wide range of voltages that may be input or available from a rig power source 910 to 48 VDC. The 48 volts VDC is provided to the remote sensing power regulator 912. The remote sensing power regulator 912 will step down the 48 VDC to between about 12 and 24 VDC measured by the remote sensing line 914 at the rig reader 902. In order to compensate a voltage drop over a long cable, the remote sensing wire 914 connects directly to the rig reader end of the power supply conductors 916. Furthermore, an overload and surge protector circuit 918 is provided and is adapted to shut down the power supply blocks of the controller interface module 900 if a surge is detected or anticipated.

Exemplary embodiments of a rig reader may comprise one or a plurality of antenna systems 810 attached to the antenna management system block depicted in FIG. 8. An exemplary antenna system is designed to overcome a variety of antenna design limitations including limitations on the size of each antenna or antenna array, the antenna system must have a 360° coverage about the asset attached to a drill stem that extends through the central portion of an exemplary cylindrical ring rig reader, the switching speed of the antennas, minimize cross talks between antenna and RF signals and minimize interference. Furthermore, an exemplary antenna system needs to be hermetically sealed within or between the radome and the interior surface of the metal ring housing of an exemplary rig reader so as to not be contaminated by any caustic or other chemicals that are present on and about an oil and gas rig.

Figure 10:
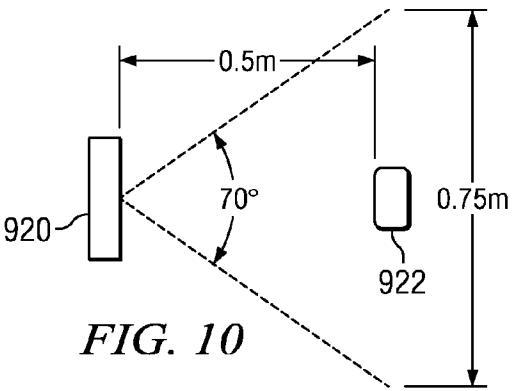
FIG. 10 depicts a drawing of the peripheral reading capability of an exemplary antenna in accordance with an embodiment of the invention.

Referring now to FIG. 10, an antenna 900 is shown in relation to a tag 902 that is on an asset (not specifically shown) passing through a read zone of an exemplary rig reader. In order to have a better understanding of the difficulty of reading the SAW ID tag 902, it should be understood that the asset or tubular pipe that the tag 902 is installed on is tripping in or out (moving up or down) at a maximum vertical speed of about 2.5 m/s while also rotating at the same time at about 120 rpm (or 2 r/s). Assuming a worst case scenario wherein the tag 922 is positioned in a near field 20 inches (about 0.5 m) in front of a rig reader antenna 920 that has a 70° peripheral coverage, the tag is exposed to the rig antenna's RF signal for about 300 ms for 0.6 of a revolution. In other words, the tag 922 is exposed to the rig antenna read field for 300 ms and is facing about half of the antenna system (0.6) located circularly about the tubular asset. If a read cycle is 20 ms, then a SAW tag can be read about three to four times by one of the four antennae in a four antennae system or about two times by one of eight antennae in an eight antennae system. Reviewing the following simple calculations reveals vertical and horizontal exposure times of a SAW tag moving in a vertical speed of 2.5 m/s and rotating at 120 rpm as it moves past the antennae read area of an exemplary rig reader.

Vertical exposure=(0.75m)/(2.5m/s)=0.3s or 300ms*80% effective range=240ms.

Horizontal exposure=(120rpm/60min)*0.3s=0.6 revolution.

Thus, for a four antennae system the number of reads per antenna element=240ms vertical exposure/20ms read-cycle per 4 antenna=3 reads.

Thus, the actual reads=3 reads*2 antenna*60% effectiveness=3-4 reads per tag.

For an eight antennae system, the reads per antenna element=240ms vertical exposure/20ms read-cycle/8 antenna=1.5 reads.

Thus, the actual reads=1.5 reads*4 antenna*60% effectiveness=3-4 reads per tag.

Figure 11A:
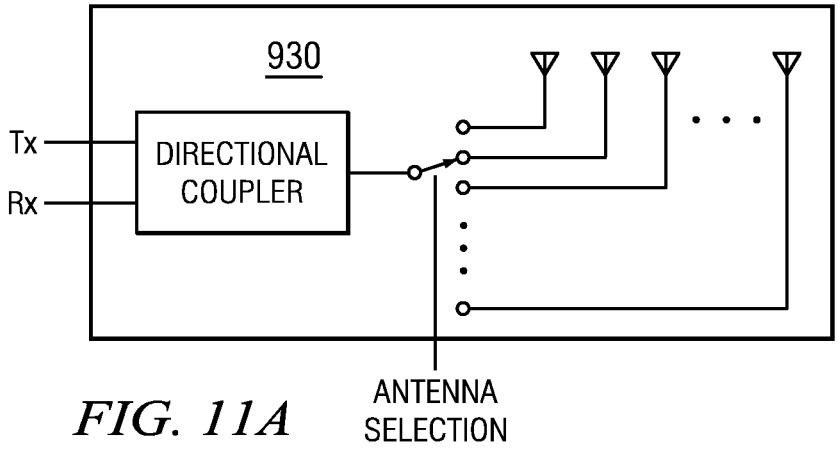
FIGS. 11A and 11B depict exemplary antenna system arrangements within an exemplary ring rig reader in accordance with embodiments of the invention.

Referring to FIG. 11A, a first exemplary antenna design 930 is shown. This is a switching mono-static antenna system 930 with four to eight antenna elements. This is a simple approach, but with lower performance due to the nature of a mono-static antenna. Another limitation is the speed of switching between antenna and read cycle processing. This exemplary design requires 12 read cycles to complete 360° coverage of three to four effective reads.

Figure 11B:
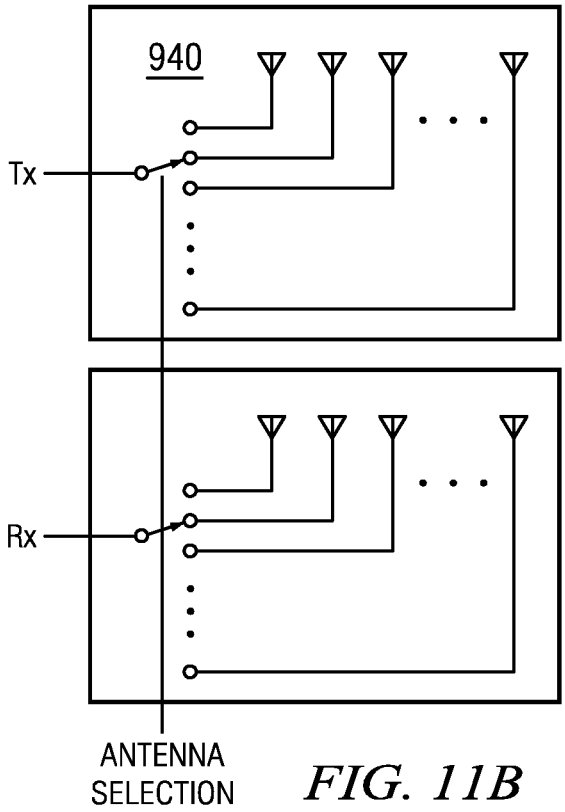

Referring now to FIG. 11B, a second exemplary antenna design 940 is depicted. This second antenna design is similar to the first antenna design except this second antenna design uses a bi-static antenna configuration 940 for better performance. One of the drawbacks is that there is a spacing limitation between each antenna placed side by side for each channel. Another limitation is the near field effect. That is, if a SAW tag to be read is too close to both the transmit and receive antenna, the tag might not be detected because it is in a blind spot. This second configuration 940 is good for larger rig readers having a larger diameter across the inner circumference of the metal ring housing that the antenna system is installed on such as is more possible on ocean or deep water rigs.

It will be appreciated by those skilled in the art having the benefit of this disclosure that this method and apparatus for automatic down-hole asset monitoring and/or rig reader system that provides for monitoring of SAW (or RFID) down-hole assets wherein the assets are part of a drilling stem and travel into and out of an oil or gas well. An exemplary rig reader system may be a ring shaped device having therein an integrated antenna array and radio frequency identification interrogators adapted to transmit a predetermined RF signal and receive a reflected RF signal from a SAW (or RFID) identification tag comprising an identification signal or indicia that can be used to keep track of asset inventory, history, repair and maintenance, ownership and other attributes thereof via a LAP computer connected to receive the identification data or indicia therefrom as well as other information that may include the time the tag is read and the direction (i.e., into the well head or out of the well head) that the asset in the drilling stem is traveling. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. An oil or gas rig down-hole asset monitoring device comprising:

a rig reader comprising:

a ring housing portion having an inner surface positioned circumferentially about an axial path through the rig reader;

a plurality of antenna mounted to and spaced about the inner surface positioned circumferentially about the axial path and adapted to transmit a selected RF signal or receive a reflected RF signal from a SAW ID tag moving through a central axial area of the ring housing along the axial path; and an interrogator device electrically connected to the plurality of antenna and mounted on the inner surface, the interrogator adapted to produce the selected RF signal for each of the plurality of antenna to transmit and adapted to receive and decipher an ID data from the reflected RF signal;

a controller interface module electrically connected to and distally located from the interrogator device, the controller interface module adapted to provide regulated power and control signals to the interrogator, the controller interface module being further adapted to receive the ID data from the interrogator device; and a Local Access Point (LAP) computer in data communication with the controller interface, the LAP computer adapted to provide the control signals to the controller interface and to receive the ID data from the controller interface.

2. The device of claim 1, wherein the rig reader further comprises a radome covering the plurality of antenna, the interrogator and a portion of the inner surface, the radome being sealed about its edges against the inner surface.

3. The device of claim 1, wherein the combination of the plurality of antenna and interrogator device are adapted to read the SAW ID tag in an amount of time being between about 5 ms and about 25 ms.

4. The device of claim 1, wherein the controller interface module is distally located from about 10 feet to about 1000 feet from the interrogator device of the rig reader.

5. The device of claim 1, wherein the ring housing may be mounted above a rig floor, below a rig floor or rig rotary table, or about or comprised as part of or about a rig bell nipple.

6. The device of claim 1, wherein the controller interface module electrically isolates the LAP computer from the interrogator device of the rig reader.

7. The device of claim 1, wherein the controller interface module is further adapted to provide the regulated power to the interrogator device of the ring reader when an asset to which the SAW ID tag is attached begins to move within the central axial area of the ring housing.

8. A rig reader device for reading electronic ID tags attached to down-hole assets as the down-hole assets are tripped into and out of an oil or gas well head, the rig reader device comprising:

an exterior housing portion comprising a central opening extending through the exterior housing portion and along a housing axis, the exterior housing portion further comprising an inner surface positioned circumferentially about the housing axis through the exterior housing portion;

a plurality of antenna mounted to and spaced about the inner surface positioned circumferentially about the housing axis and adapted to transmit a selected RF signal or receive a reflected RF signal from an electronic ID tag attached to a down-hole asset moving through the central opening in a direction substantially parallel to and near the housing axis; and an interrogator device electrically connected to the plurality of antenna and mounted to the inner surface, the interrogator adapted to produce the selected RF signal for each of the plurality of antenna to transmit and adapted to receive and decipher an ID data from the reflected RF signal; and a radome covering the plurality of antenna, the interrogator and a portion of the inner surface, the radome being sealed about its edges against the inner surface.

9. The rig reader device of claim 8, wherein the exterior housing is ring shaped.

10. The rig reader device of claim 8, wherein the interrogator device further comprises a plurality of slave interrogator devices electrically connected to the interrogator device and to at least to one of the plurality of antennae.

11. The rig reader of claim 8, further comprising brackets for mounting the rig reader to a top or bottom of a rig floor.

12. A method of scanning a SAW ID tag mounted on a tagged asset as the tagged asset moves along an axial path through a rig reader mounted on an oil or gas rig, the method comprising:

providing power from a distally located controller interface module to the rig reader after sensing that the asset is moving either axially or rotationally;

initializing a microcontroller and DSP processor of an interrogator device in the rig reader;

receiving process commands, by the interrogator device, from the distally located controller interface module;

providing a transmit RF signal to a plurality of antennae in a predetermined switched manner, the plurality of antennae being mounted on and spaced about an inner rig reader surface positioned circumferentially about the axial path;

receiving a SAW ID tag signal reflected from the SAW ID tag by at least one of the plurality of antennae;

providing the received SAW ID tag signal to the DSP processor and formatting the SAW ID tag signal into SAW ID data;

sending the SAW ID data from the interrogator device to the distally located controller interface.

13. The method of claim 12, wherein the steps of method 12 are performed in a time period of between about 10 ms and 30 ms.

14. The method of claim 12, further comprising receiving process commands by the distally located controller interface device, which occurs prior to receiving process commands by the interrogator device.

15. The method of claim 12, wherein receiving the SAW ID tag signal reflected from the SAW ID tag is received by 3 to 4 of the plurality of antennae.

16. The method of claim 12, wherein sending the SAW ID data from the interrogator device occurs after the SAW ID data is temporarily stored in a FIFO memory.

* * * * *